US005257456A

United States Patent [19]

Franke et al.

[11] Patent Number: 5,257,456

[45] Date of Patent: Nov. 2, 1993

[54] SHAVING APPARATUS

[75] Inventors: Wolfgang Franke, Langen; Helmut Dürr, Frankfurt am Main; Gebhard Braun, Kelkheim; Reinhold Eichhorn, Idstein-Kröftel, all of Fed. Rep. of Germany

[73] Assignee: Braun Aktiengesellschaft, Fed. Rep. of Germany

[21] Appl. No.: 931,851

[22] Filed: Aug. 18, 1992

[30] Foreign Application Priority Data

Aug. 26, 1991 [DE] Fed. Rep. of Germany ..... 4128219

[51] Int. Cl.[5] ..... B26B 19/12

[52] U.S. Cl. ..... 30/43.92; 30/43.1; 30/43.91

[58] Field of Search ..... 30/43.3, 43.7, 43.8, 30/43.92, 43.91, 89, 43.92, 43.1

[56] References Cited

U.S. PATENT DOCUMENTS 3,858,314 1/1975 Brenneman .
4,219,930 9/1980 Franko et al. .
4,292,737 10/1981 Packham ..... 30/43.92
4,492,024 1/1985 Jacobson .
4,796,359 1/1989 Oprach et al. ..... 30/43.92
4,797,997 1/1989 Packham ..... 30/43.92
4,845,847 7/1987 Yasunaka et al. ..... 30/43.92
4,930,217 6/1990 Wolf et al. ..... 30/43.92

FOREIGN PATENT DOCUMENTS 3926894 12/1990 Fed. Rep. of Germany .

*Primary Examiner*—Hien H. Phan
*Assistant Examiner*—Paul M. Heyrana, Jr.
*Attorney, Agent, or Firm*—Fish & Richardson

[57] ABSTRACT

The invention is directed to an electric shaving apparatus having a housing and a shaving head assembly which is adapted to pivot relative to the housing about a pivotal axis Z and is comprised of a shaving plane formed by at least one outer cutter having arcuate extensions to the longitudinal sides of the shaving head frame, and of at least one inner cutter operatively associated with the outer cutter and driven by a drive mechanism, wherein the inner cutter is coupled to the drive mechanism arranged in the housing by means of a coupling member in a manner permitting pivotal movement about the pivotal axis Z.

20 Claims, 4 Drawing Sheets

SHAVING APPARATUS

Figure 1:
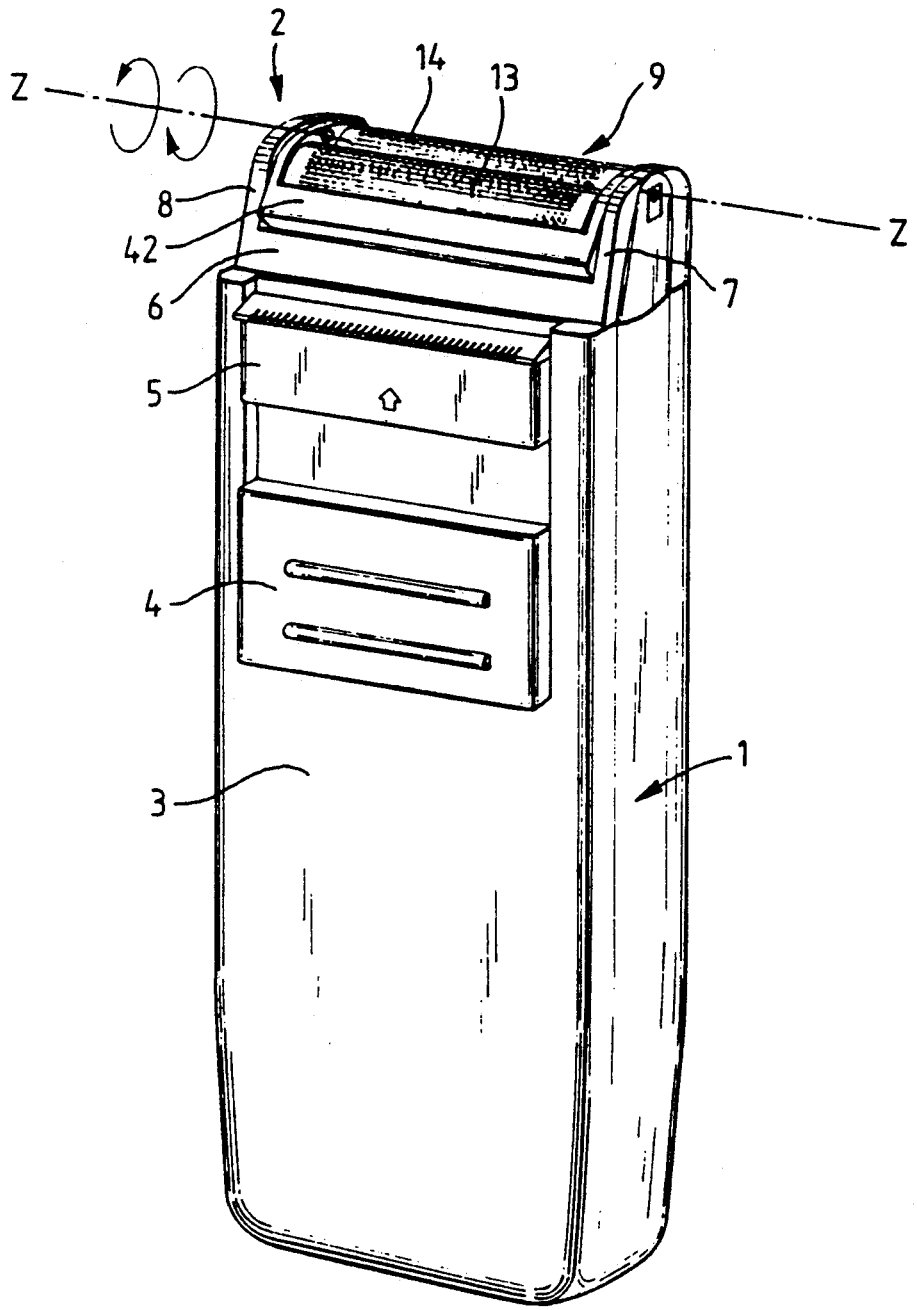

This invention relates to an electric shaving apparatus having a housing and a shaving head assembly which is adapted to pivot relative to the housing about a pivotal axis and is comprised of a shaving plane formed by at least one outer cutter and of at least one inner cutter operatively associated with the outer cutter and driven by a drive mechanism.

A shaving apparatus of the type initially referred to is known from DE-C1 39 26 894. The shaving assembly enclosed on all sides comprises a shaving head frame mounted between two support lugs so as to be pivotal about the pivotal axis Z, the shaving head frame having attached to its one end an outer cutter and to its other end a bottom plate, further comprising an inner cutter disposed between the bottom plate and the outer cutter, the inner cutter being caused to oscillate by drive members provided in the shaving head frame and on the bottom plate, the drive members being operated by the drive means provided in the housing of the shaving apparatus.

It is an object of the present invention to improve upon the shaving head assembly of a shaving apparatus of the type initially referred to.

According to the present invention, this object is accomplished in a shaving apparatus of the type initially referred to in that the inner cutter is connected to the drive mechanism by means of a coupling member permitting the pivotal movement about the pivotal axis. Considering that the inner cutter is coupled to the drive mechanism directly and in a manner allowing pivotal movement about the pivotal axis Z, the shaving assembly is split into two separable subassemblies including an inner cutter mechanism directly associated with the drive mechanism arranged in the housing of the shaving apparatus, and an outer cutter mechanism mounted in the shaving head frame pivotally about the pivotal axis Z. Separating the outer cutter mechanism from the inner cutter mechanism simplifies the construction and allows low-cost manufacture of a shaving assembly pivotal about a pivotal axis. Owing to the pivotal capability of the inner cutter and the coupling to the drive mechanism, the shaving head frame is open at the end proximate to the housing, being thus directly seatable down onto the housing and adapted to be coupled thereto in a detachable manner. This accordingly eliminates the need for the bottom plate necessary in the shaving head assembly of the prior art and for the driving elements provided between the bottom plate and the inner cutter for oscillating the inner cutter.

The transmission of the oscillating movement from the drive mechanism to the inner cutter is substantially simplified, requiring less driving power.

In another feature of the present invention, a recess functioning as a control cam for a push rod adapted to be acted upon by a spring is provided on the coupling member, the recess extending concentrically with the pivotal axis Z. In combination with the push rod bearing under spring pressure against the wall extending concentrically with the pivotal axis Z, the recess configured as a control cam ensures a perfect pivotal movement of the inner cutter about the pivotal axis Z, as well as a resilient engagement of the inner cutter with the outer cutter. By this means, the relative cooperation of the separately pivoted cutting elements which include the outer cutter and the associated inner cutter directly driven by the drive mechanism is optimized, resulting in an improved cutting performance.

The coupling member is suitably adapted to be coupled to the drive mechanism by means of a drive sleeve engaging in a U-shaped recess provided on the coupling member.

The recess is preferably provided in the U-shaped recess.

The push rod and the spring are suitably mounted inside the drive sleeve.

In a preferred embodiment of the present invention, the drive sleeve has a cylindrical cup in which the push rod is arranged to be slidable against the pressure of the spring. In a further feature of this embodiment, an annular outer bead is provided on the circumferential outer surface of the cylindrical cup. Preferably, the outer bead is shaped to correspond to a sector of a sphere.

In accordance with the present invention, a particularly simple, low-cost and at all times detachable coupling of the inner cutter to the drive mechanism is accomplished in that lugs are provided on the outer walls of the coupling member, and the drive mechanism includes a coupling sleeve seated on a shoulder of the drive sleeve and surrounding the drive sleeve, with fastening hooks and a shoulder being provided thereon.

In an embodiment of the present invention, the drive sleeve is coupled to an oscillating member by means of the shoulder and by fastening hooks embracing the shoulder on the coupling sleeve.

The fastening hooks are suitably provided directly on the oscillating member or on a supporting plate secured to an oscillating member.

In a preferred embodiment of the present invention, the coupling member is adapted to be coupled to the drive mechanism by means of the lugs engaging the fastening hooks.

In order to facilitate the assembly or demounting of the shaving head frame coupled to the housing, the lugs are each provided with a control cam and a recess for engagement of the fastening hooks.

The recess is preferably provided in the center of the control cam.

The fastening hooks are suitably provided with locking cams for engagement with the recesses.

The pivotal movement of the inner cutter about the pivotal axis Z is suitably accomplished by the action of the pivotally mounted outer cutter on the inner cutter.

Figure 1A:
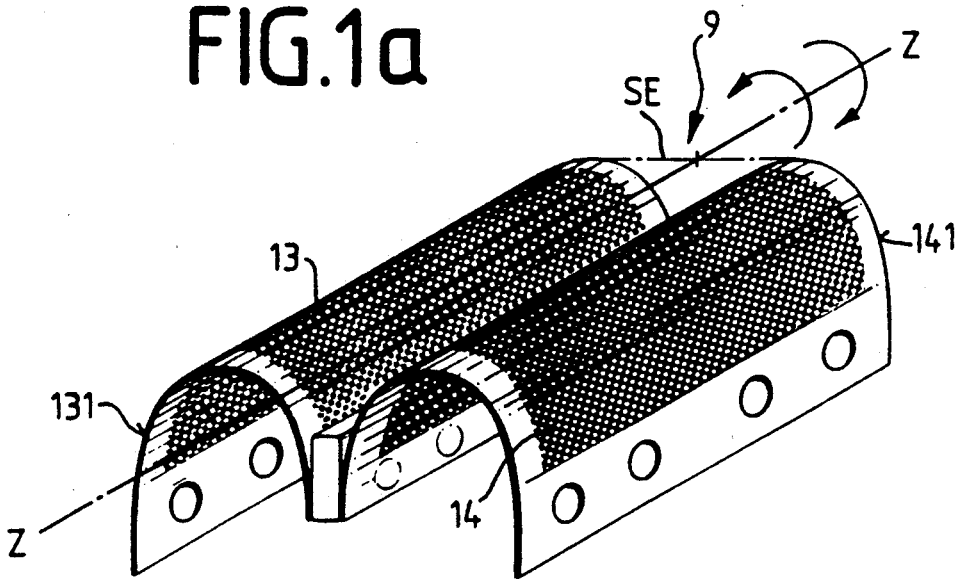
Figure 4:
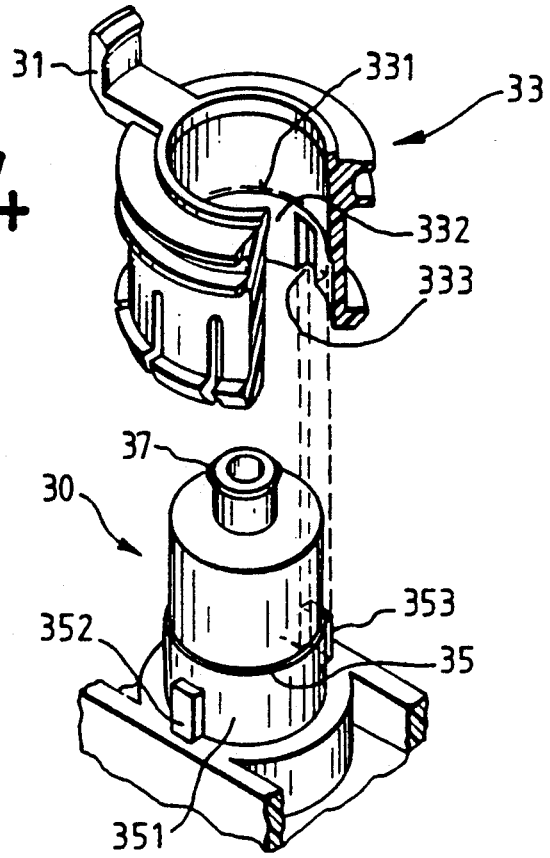
Figure 2:
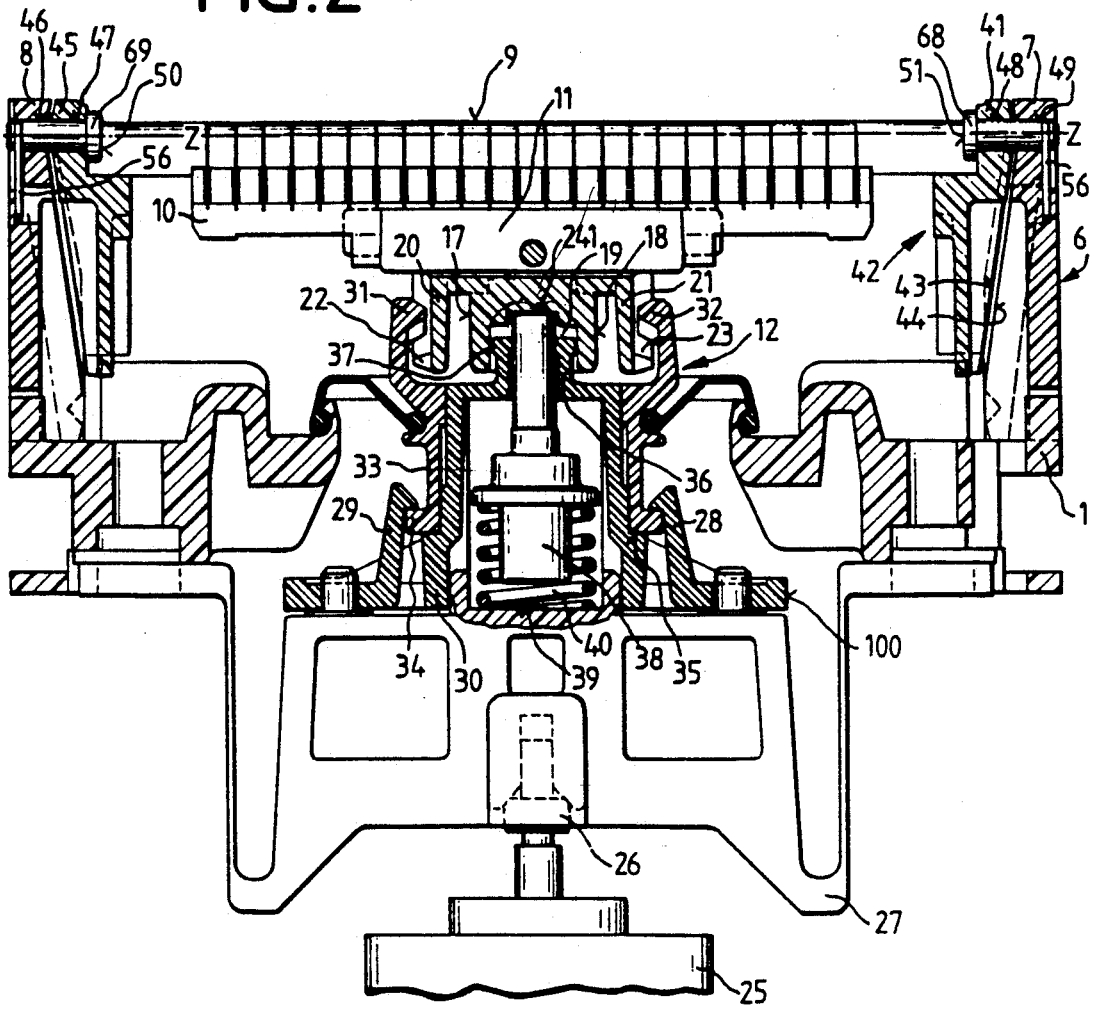
Figure 2A:
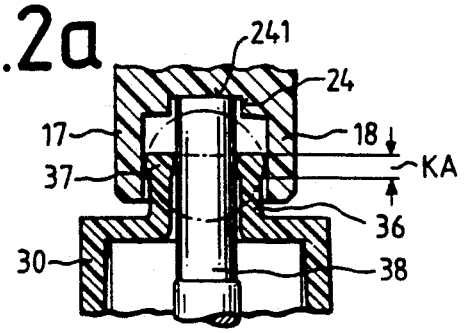
Figure 3:
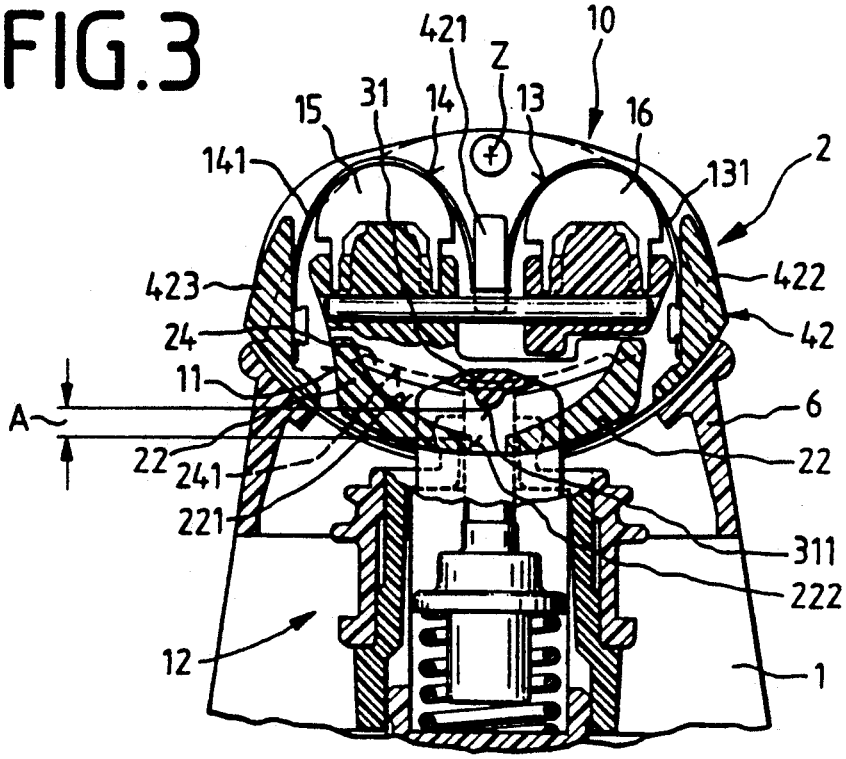
Figure 3A:
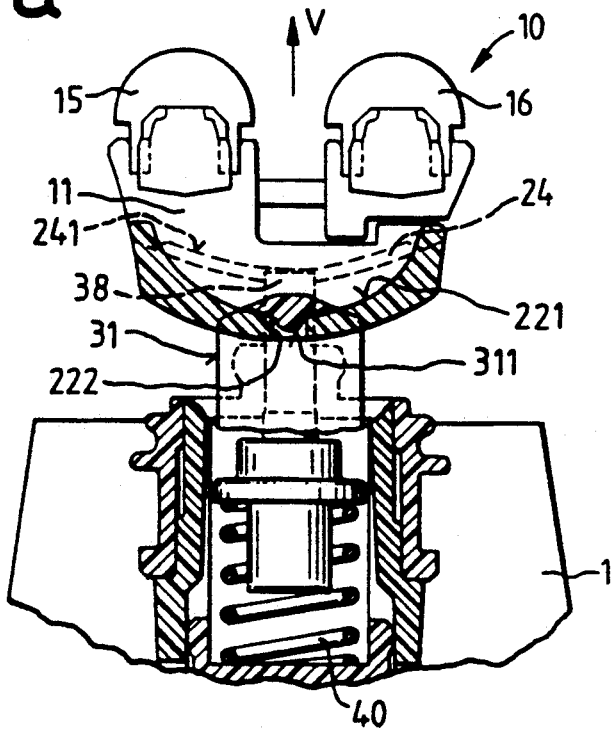

A preferred embodiment of the present invention will be described in the following with reference to the accompanying drawings. In the drawings, FIG. 1 is a perspective view of a shaving apparatus including a shaving head frame and a pivotally mounted frame member for an outer cutter;

FIG. 1*a* is a perspective view of an outer cutter having two arched shaving surfaces extending parallel to each other;

FIG. 2 is a sectional view of a shaving head frame, a frame member for an outer cutter, and a drive mechanism;

FIG. 2*a* is a sectional view of cylindrical cup including a spherical sector KA;

FIG. 3 is a sectional view of a shaving head assembly including a pivotally mounted frame member for an outer cutter;

FIG. 3*a* is a sectional view as in FIG. 3 but with the shaving head frame removed; and FIG. 4 is an exploded view of a drive sleeve and a coupling sleeve.

Referring now to FIG. 1 of the drawings, there is shown an electric shaving apparatus having a housing 1 and a shaving head assembly 2 adapted to pivot relative to the housing 1 about a pivotal axis Z, as well as an On-Off switch 4 slidable in the front panel 3 and having associated therewith a slidable long-hair trimmer 5.

The shaving head assembly 2 is comprised of a shaving head frame 6 arranged on the housing 1, an outer cutter 9 mounted intermediate end walls 7, 8 so as to be pivotal about the pivotal axis Z, and an inner cutter 10 —see FIG. 2—engaging the outer cutter 9 and being coupled to a drive mechanism 12 arranged in the housing 1 by means of a coupling member 11 in both a driving and a pivotal relationship about the pivotal axis Z, with the pivotal movement of the inner cutter 10 being accomplished by the action of the pivotally mounted outer cutter 9 on the inner cutter 10.

The shaving head frame 6 is removably secured to the housing 1 by means of a locking mechanism. The frame member 42 for the outer cutter and the shaving head frame 6 are coupled to each other by means of bearing pins 50, 51 extending through respective bearing bores 46, 47 and 48, 49 in respective end walls 8, 45 and 7, 41, and by means of mounting plates 56 serving to secure the bearing pins 50, 51. The center axis of the bearing pins 50, 51 lies on the pivotal axis Z.

The outer cutter 9 includes two arched shaving surfaces 13, 14 extending parallel to the pivotal axis Z. The tangential plane connecting the arched shaving surfaces 13 and 14 is an imaginary plane referred to as shaving plane SE—see FIG. 1*a*. As becomes apparent from FIG. 3, the shaving surfaces 13 and 14 are formed by two shaving foils 131, 141 attached to the frame member 42 for the outer cutter in arched form. The two shaving foils 131 and 141 are each fastened to a web member 421 provided inside the frame member 42 for the outer cutter and extending parallel to the pivotal axis Z, while their opposed longitudinal sides are coupled to a respective one of the side walls 422, 423 of the frame member 42 for the outer cutter, which side walls extend equally parallel to the pivotal axis.

In an embodiment illustrated in FIG. 3, the inner cutter 10 is comprised of two parallel blade assemblies 15, 16 of arcuate form arranged on the common coupling member 11. As becomes apparent from FIG. 2, at the end proximate to the drive mechanism 12 the coupling member 11 includes four parallel walls, whereof the opposed inner walls 17 and 18 form a U-shaped recess 19 and the two outer walls 20, 21 are each provided with a respective outwardly extending lug 22, 23. In the U-shaped recess 19, another U-shaped recess 24 is provided, its arcuately extending wall 241 being conformed to the pivotal movement of the outer cutter 9 about the pivotal axis Z.

The drive mechanism 12 is comprised of an oscillating member 27 arranged in the housing 1 and driven by a motor 25 by means of an eccentric member 26, as well as of coupling members mounted on the oscillating member 27, including, for example, a supporting plate 100 having fastening hooks 28, 29 by means of which a drive sleeve 30 and a coupling sleeve 33 having likewise fastening hooks 31, 32 are secured to the supporting plate 100 by engagement with suitable annular shoulders 34, 35. At its end proximate to the inner cutter 10, the drive sleeve 30 has a cylindrical cup 36 with an annular outer bead 37 shaped to correspond to a sector of a sphere KA—see FIG. 2*a*. With the inner cutter 10 coupled to the drive sleeve 30, the outer bead 37 is in abutment with the insides of the inner walls 17 and 18, thus ensuring a transmission of the oscillating movement of the oscillating member 27 to the inner cutter 10 and also a seating of the inner cutter 10 on the drive sleeve 30 in a manner permitting pivotal movements. A push rod 38 extending through the cylindrical cup 36 is arranged in the cup-shaped drive sleeve 30. Seated between the upper side 39 of the oscillating member 27 and the push rod 38 is a spring 40 acting on the push rod 38 to maintain it at all times in engagement with the arcuate contour of the wall 241 of the recess 24 extending concentrically with the pivotal axis Z in the coupling member 11, in order to transmit the force of the spring 40 to the inner cutter 10 for the purpose of resiliently urging the inner cutter 10 into engagement with the outer cutter 9. With its fastening hooks 31, 32, the coupling sleeve 33 surrounding the drive sleeve 30 embraces the lugs 22 and 23 formed on the outer walls 20, 21 of the coupling member 11, and a predetermined flexibility of the fastening hooks 31 and 32 ensures at all times ease of handling, enabling the inner cutter 10 to be readily coupled to, and uncoupled from, the drive mechanism. The fastening hooks 28, 29 are equally of a flexible configuration, thus facilitating the assembly and demounting of push rod 38, spring 40, drive sleeve 30 and coupling sleeve 33 on the oscillating member 27.

FIG. 3 shows a section through a shaving head frame 6 seated on the housing 1, a frame member 42 for an outer cutter, an inner cutter 10, as well as a coupling member 11 and a coupling sleeve 33, the section being taken through the fastening hook 31 of the coupling sleeve 33 and the lug 22 of the coupling member 11. A locking cam 311 is provided on the fastening hook 31. In the assembled condition of housing 1, shaving head frame 6 and frame member 42 for the outer cutter, the locking cam 311 of the fastening hook 31 is at a distance A from and above the lug 22 provided with a control cam 221 and a recess 222. The distance A is adjusted automatically as the shaving head frame 6 is mounted on the housing 1, because during assembly the two blade assemblies 15, 16 disposed on the coupling member 11 are moved vertically downwardly by the associated shaving foils 131, 141 in opposition to the pressure of the push rod 38 acted upon by the spring 40.

FIG. 3*a* shows a part section through the shaving apparatus of FIG. 3, illustrating a shaving head frame 6 removed from the housing 1. The removal of the shaving head frame 6 from the housing 1 produces an upward movement, in vertical direction V, of the push rod 38 abutting the wall 241 of the coupling member 11 under the action of the spring 40, until the locking cam 311, after traveling the distance A, engages the control cam 221, which occurs in dependence upon the respective pivot position of the inner cutter 10. Utilizing the resilience of the spring 40, the control cam 221 subsequently slides along the locking cam 311 until the locking cam 311 falls into the recess 222 provided in the control cam 221. In the embodiment shown in FIG. 3*a*, the recess 222 is provided in the center of the arcuate control cam 221, causing, after locking engagement of the locking cam 311 centered position lying in the middle of the predetermined pivot range of the inner cutter 10 pivotal in clockwise and counterclockwise direction. It will be understood that a control cam, not shown, having a prismatic control area whose prismatic surfaces terminate in a recess may be substituted for the arcuate control cam 221.

The lug 23 of the coupling member 11 and the second fastening hook 32 provided on the coupling sleeve 33 are configured in accordance with the lug 22 and the fastening hook 31 previously described and are disposed in a 180-degree offset relation thereto.

The movement and the locking engagement of the inner cutter 10 in the centered position shown which occur automatically on removal of the shaving head frame 6 from the housing 1 under the pressure of the spring 40 acting on the push rod 38 permit ease of cleaning of the inner cutter 10 coupled to the drive mechanism as well as ready seating of the shaving head frame 6 equipped with a pivotally carried outer cutter 9 on the housing 1.

By placing the shaving head frame 6 down onto the housing 1, the outer cutter 9 acts on the inner cutter 10 with the coupling member 11 and on the push rod 38, thereby urging the parts vertically downwardly against the pressure of the spring 40, as a result of which the locking engagement obtained by the locking cams 311, the fastening hooks 31 and 32 and the recesses 222 in the control cams 221 is automatically canceled, as illustrated in FIG. 3. In this condition, the inner cutter 10, in combination with the outer cutter 9, is free to pivot about the pivotal axis Z.

FIG. 4 shows an exploded view of the drive sleeve 30 and the coupling sleeve 33 adapted to be coupled to each other. Provided on the circumferential outer surface 351 of the shoulder 35 of the drive sleeve 30 are, for example, two locking means 352, 353 protruding from the circumferential outer surface 351 in diametrically opposite arrangement. The inner wall of the coupling sleeve is of a stepped configuration, thereby providing a shoulder 331. In the wall of the circumferential inner surface 332, locking means formed by four recesses 333 for locking engagement with the locking means 352, 353 are arranged at a relative spacing of 90 degrees. In the coupled condition of drive sleeve 30 and coupling sleeve 33, two recesses 333 are in engagement with the locking means 352 and 353, with the fastening hooks 31 and 32 being disposed in a 90-degree offset relation to the locking means 352 and 353, being accordingly in parallel alignment with the pivotal axis Z—see FIG. 2. This results in an optimum orientation of the inner cutter 10 parallel to the pivotal axis Z, in addition to facilitating the assembly and demounting of the shaving head frame 6 to and from the housing 1. Following removal of the shaving head frame 6 from the housing 1, the inner cutter 10 coupled to the coupling sleeve 33 may be turned 90 degrees, causing the further recesses 333 provided in the coupling sleeve 33 to engage the locking means 352 and 353, thereby locking the coupling sleeve 33 coupled to the inner cutter 10 in an orientation transversely to the pivotal axis Z. With the inner cutter 10 in this position, both the inner cutter 10 and the upper end of the housing 1 can be cleaned easily.

We claim:

1. Electric shaving apparatus comprising housing structure, a shaving head assembly mounted on said housing structure for pivotal movement about a pivotal axis (Z), said shaving head assembly comprising outer cutter structure and at least one inner cutter operatively associated with said outer cutter structure, an electric drive mechanism, drive structure coupled to said electric drive mechanism, said drive structure including a drive member and spring structure, coupling structure coupled to said drive structure, and including the cam structure that extends concentrically with said pivotal axis, said inner cutter being movably coupled to said coupling structure for oscillating movement as driven by said drive mechanism, said drive member being resiliently urged into engagement with said cam structure by said spring structure and arranged to be slidable against the pressure of said spring structure in engagement with said cam structure, such that said inner cutter is urged into resilient abutting engagement with said outer cutter structure by abutment of said drive member against said coupling structure.

2. The electric shaving apparatus of claim 1 wherein said drive member is a push rod adapted to be acted upon by said spring structure and said cam structure is a cam recess that extends concentrically with said pivotal axis (Z).

3. The electric shaving apparatus of claim 2 wherein said coupling structure includes a coupling member with a U-shaped recess, and said drive structure includes a drive sleeve adapted to engage in said U-shaped recess.

4. The electric shaving apparatus of claim 3 wherein said cam recess is provided in said U-shaped recess.

5. The electric shaving apparatus of claim 3 wherein said push rod and said spring structure are mounted inside said drive sleeve.

6. The electric shaving apparatus of claim 5 wherein said drive sleeve includes a cylindrical cup in which said push rod is arranged to be slidable against the pressure of said spring structure.

7. The electric shaving apparatus of claim 6 wherein said cup has a circumferential outer surface with an annular outer bead on said outer surface.

8. The electric shaving apparatus of claim 7 wherein said outer bead is shaped to correspond to a sector of a sphere (KA).

9. The electric shaving apparatus of claim 1 and further including lug structure on an outer surface of said coupling structure.

10. The electric shaving apparatus of claim 1 wherein said drive structure includes a drive sleeve with a drive shoulder, and a coupling sleeve seated on said shoulder of said drive sleeve and surrounding said drive sleeve, and further including first fastening hook structure and a coupling shoulder on said coupling sleeve.

11. The electric shaving apparatus of claim 10 wherein said drive sleeve is coupled to said coupling structure by means of said drive shoulder and second fastening hook structure embracing said coupling shoulder.

12. The electric shaving apparatus of claim 10 wherein said second fastening hook structure is directly on said drive structure.

13. The electric shaving apparatus of claim 10 wherein said coupling structure includes lug structure and said coupling structure is adapted to be coupled to said drive mechanism by means of said lug structure engaging said second fastening hook structure.

14. The electric shaving apparatus of claim 13 wherein said lug structure includes control cam structure and recess structure for engagement with said second fastening hook structure.

15. The electric shaving apparatus of claim 14 wherein said recess structure is provided in the center of said control cam structure.

16. The electric shaving apparatus of claim 14 wherein said second fastening hook structure includes locking cam structure for engagement with said recess structure.

17. The electric shaving apparatus of claim 1 wherein the pivotal movement of said inner cutter about said pivotal axis (Z) is accomplished by the action of said pivotally mounted outer cutter on said inner cutter.

18. The electric shaving apparatus of claim 17 wherein said drive structure includes a drive sleeve with a drive shoulder, and a coupling sleeve seated on said shoulder of said drive sleeve and surrounding said drive sleeve, and further including first fastening hook structure and a coupling shoulder on said coupling sleeve, said drive sleeve being coupled to said coupling structure by means of said drive shoulder and second fastening hook structure embracing said coupling shoulder.

19. The electric shaving apparatus of claim 18 wherein said drive member is a push rod adapted to be acted upon by said spring structure, said cam structure is a cam recess that extends concentrically with said pivotal axis (Z), said coupling structure includes a coupling member with a U-shaped recess, and said drive sleeve is adapted to engage in said U-shaped recess.

20. The electric shaving apparatus of claim 19 wherein said drive sleeve includes a cylindrical cup in which said push rod is arranged to be slidable against the pressure of said spring structure, and said cup has a circumferential outer surface with an annular outer bead on said outer surface shaped to correspond to a sector of a sphere (KA).

* * * * *